US008292252B2

(12) United States Patent
Busekros et al.

(10) Patent No.: US 8,292,252 B2
(45) Date of Patent: Oct. 23, 2012

(54) SUPPORT FOR A TURBINE

(75) Inventors: Armin Busekros, Zürich (CH); Pascal Prehm, Untersiggenthal (CH); Miroslav Cindric, Karlovac (HR); Dominic Bürgi, Zürich (CH)

(73) Assignee: ALSTOM Technology Ltd., Baden (CH)

( * ) Notice: Subject to any disclaimer, the term of this patent is extended or adjusted under 35 U.S.C. 154(b) by 333 days.

(21) Appl. No.: 12/720,168

(22) Filed: Mar. 9, 2010

(65) Prior Publication Data

US 2010/0237221 A1 Sep. 23, 2010

(30) Foreign Application Priority Data

Mar. 17, 2009 (CH) ..... 0397/09

(51) Int. Cl.
*F16M 3/00* (2006.01)

(52) U.S. Cl. ..... 248/672; 248/674

(58) Field of Classification Search ..... 248/672, 248/674, 676, 637, 644, 680
See application file for complete search history.

(56) References Cited

U.S. PATENT DOCUMENTS

| | | | |
|---|---|---|---|
| 103,380 | A | 5/1870 | Smith |
| 1,499,954 | A | 7/1924 | Stiles |
| 1,522,190 | A | 1/1925 | Junggren |
| 3,014,741 | A | 12/1961 | McDowall |
| 3,043,003 | A | 7/1962 | Lever |
| 3,126,035 | A | 3/1964 | Espetvedt |
| 3,628,572 | A | 12/1971 | Shannon |
| 4,109,944 | A | 8/1978 | Curtin |
| 4,431,373 | A | 2/1984 | Monsarrat |
| 4,921,401 | A | 5/1990 | Hall et al. |
| 4,967,800 | A | 11/1990 | Heilmayr et al. |
| 5,007,666 | A | 4/1991 | Kyfes |
| 5,542,642 | A | 8/1996 | Rivard |
| 5,875,821 | A | 3/1999 | Dumser et al. |
| 6,247,500 | B1 | 6/2001 | McMahon |
| 6,273,675 | B1 | 8/2001 | Magoshi et al. |
| 6,336,789 | B1 | 1/2002 | Beerens et al. |

(Continued)

FOREIGN PATENT DOCUMENTS

| | | |
|---|---|---|
| DE | 1056624 | 5/1959 |

(Continued)

OTHER PUBLICATIONS

Search Report for Swiss Patent App. No. 1382/2005 (Dec. 27, 2005).
Search Report for Swiss Patent App. No. 00397/2009 (Aug. 7, 2009).

*Primary Examiner* — Ramon Ramirez
(74) *Attorney, Agent, or Firm* — Cermak Nakajima LLP; Adam J. Cermak

(57) ABSTRACT

In a support for a turbine, which turbine has an outer casing which is split into an upper section (11) and a lower section (12) in a horizontal parting plane, in which upper section (11) and lower section (12) are screwed to each other on a horizontal flange (13; 13*a*, 13*b*) which lies in the parting plane, the support includes a multiplicity of essentially vertical supports (31) which by an upper end act on the outer casing (18) and by the lower end are supported on a foundation. With such a support, optimum points of application on the outer casing are achieved with the threaded flange connection without limitations by one or more of the supports (31) acting by the upper end on the horizontal flange (13; 13*a*, 13*b*) and being part of the horizontal threaded flange connection.

5 Claims, 3 Drawing Sheets

U.S. PATENT DOCUMENTS

| | | | | |
|---|---|---|---|---|
| 6,431,216 | B1 | 8/2002 | Briscoe | |
| 6,550,819 | B2 | 4/2003 | DeSanto, Sr. | |
| 7,681,601 | B2 | 3/2010 | Kriz | |
| 8,028,967 | B2 * | 10/2011 | Busekros et al. | 248/671 |
| 2006/0285971 | A1 | 12/2006 | Matheny | |
| 2007/0044860 | A1 | 3/2007 | Kriz | |
| 2007/0086854 | A1 * | 4/2007 | Blanton | 403/338 |
| 2010/0320360 | A1 * | 12/2010 | McLeod | 248/678 |

FOREIGN PATENT DOCUMENTS

| | | | |
|---|---|---|---|
| DE | 7415587 | | 2/1976 |
| DE | 7814269 | U1 | 5/1978 |
| EP | 0785389 | | 7/1997 |
| GB | 228172 | | 5/1925 |
| JP | 52119704 | | 10/1977 |
| SU | 364750 | | 12/1972 |

* cited by examiner

SUPPORT FOR A TURBINE

This application claims priority under 35 U.S.C. §119 to Swiss application no. 00397/09, filed 17 Mar. 2009, the entirety of which is incorporated by reference herein.

BACKGROUND

1. Field of Endeavor

The present invention relates to the field of turbomachines, and more particularly to a support for a turbine having a horizontally split outer casing.

2. Brief Description of the Related Art

In the case of turbomachines which operate with thermal processes, such as gas turbines, thermal expansions occur on the casing when running up, which are borne by special supports of the outer casing (see, for example, DE-UI-78 14 269 or EP-A1-0 785 389 or U.S. Pat. No. 5,542,642).

A possible configuration of such a supported turbomachine or turbine is reproduced in FIG. 1. The turbine 10 which is shown in FIG. 1 has an outer casing 18 which is split into an upper section 11 and a lower section 12 along a horizontal parting plane which goes through the machine axis 17. Upper part 11 and lower part 12 are connected or screwed to each other in a sealed manner in the parting plane via a horizontal flange 13. A plurality of vertical supports 14, 15 and 16, which by the upper end act on the outer casing 18 and by the lower end are supported on a floor or foundation (not shown), are arranged in a distributed manner along the outer casing 18.

The supports 14, 15, and 16 in this case can either act completely or partially on a separate integral casting on the outer casing 18 which results in the forces and moments which act upon the casing being increased as a result of the longer lever arm. Furthermore, a separate integral casting can possibly lead to undesirable larger transporting dimensions.

In order to avoid this, the supports 14, 15, and 16 can be brought as close as possible to the neutral axis of the casing, where the threaded flange connection is located. This, however, leads to a screw of the threaded flange connection having to be omitted for space reasons at the point where the respective support is attached. This can lead to problems with the sealing tightness of the outer casing.

Two variants of such a previously known support are shown in FIGS. 2 and 3. In the case of the variant according to FIG. 2, the upper end of a support 19, which is provided with a male thread 23, is inserted through a through-hole 24 in the lower flange 13*b* of the horizontal flange 13 and screwed to the lower flange 13*b*. A lower fastening nut 21, which is screwed onto the support 19, and an upper fastening nut 20 serve for this purpose. So that the upper fastening nut 20 can be screwed onto the support 19, a corresponding opening is provided in the upper flange 13*a*. A threaded connection of the two flanges 13*a* and 13*b* is not possible at this point. This also applies in the case of the variant according to FIG. 3 in which the support 19 by its male thread 23 is screwed into a corresponding threaded hole 25 in the lower flange 13*b* and locked with a locknut 22.

SUMMARY

One of numerous aspects of the present invention relates to a support for a turbine with a split outer casing which can avoid the disadvantages of the previous supports and which is characterized in particular by an optimum positioning of the support without negative influences on the sealing tightness of the threaded flange connection.

Another of these aspects includes that one or more of the supports acts by the upper end on the horizontal flange and is part of the horizontal threaded flange connection. For this purpose, the support can be shifted into a mechanically optimum position without a sealing threaded connection having to be dispensed with at the position there.

Another aspect includes that the horizontal flange comprises an upper flange and a lower flange which are screwed to each other, that the supports which are used as part of the horizontal threaded connection are fixed in each case by their upper end in the lower flange in such a way that they are accessible from the upper side of the lower flange, and that for threaded connecting of the flanges a flange screw can be screwed in each case through a through-hole in the upper flange into the support which is fixed in the lower flange.

In particular, the supports which are used as part of the horizontal threaded connection can be screwed into the lower flange in each case for fixing in the lower flange. For fixing in the lower flange, the supports in this case can be preferably screwed into the lower flange up to a stop in such a way that a sufficient gap remains between the upper end face of the support and the underside of the upper flange.

Another aspect includes that the supports which are used as part of the horizontal threaded connection are formed as cylindrical rods and, for accommodating the flange screws at the upper end, each have a concentric threaded hole which is introduced from the face end.

In this case, it is mechanically advantageous if the supports which are used as part of the horizontal threaded connection adjoin the upper side of the lower flange by their end faces in an essentially flush manner.

BRIEF DESCRIPTION OF THE DRAWINGS

The invention shall subsequently be explained in more detail based on exemplary embodiments in conjunction with the drawing. In the drawings.

DETAILED DESCRIPTION OF EXEMPLARY EMBODIMENTS

Figure 1:
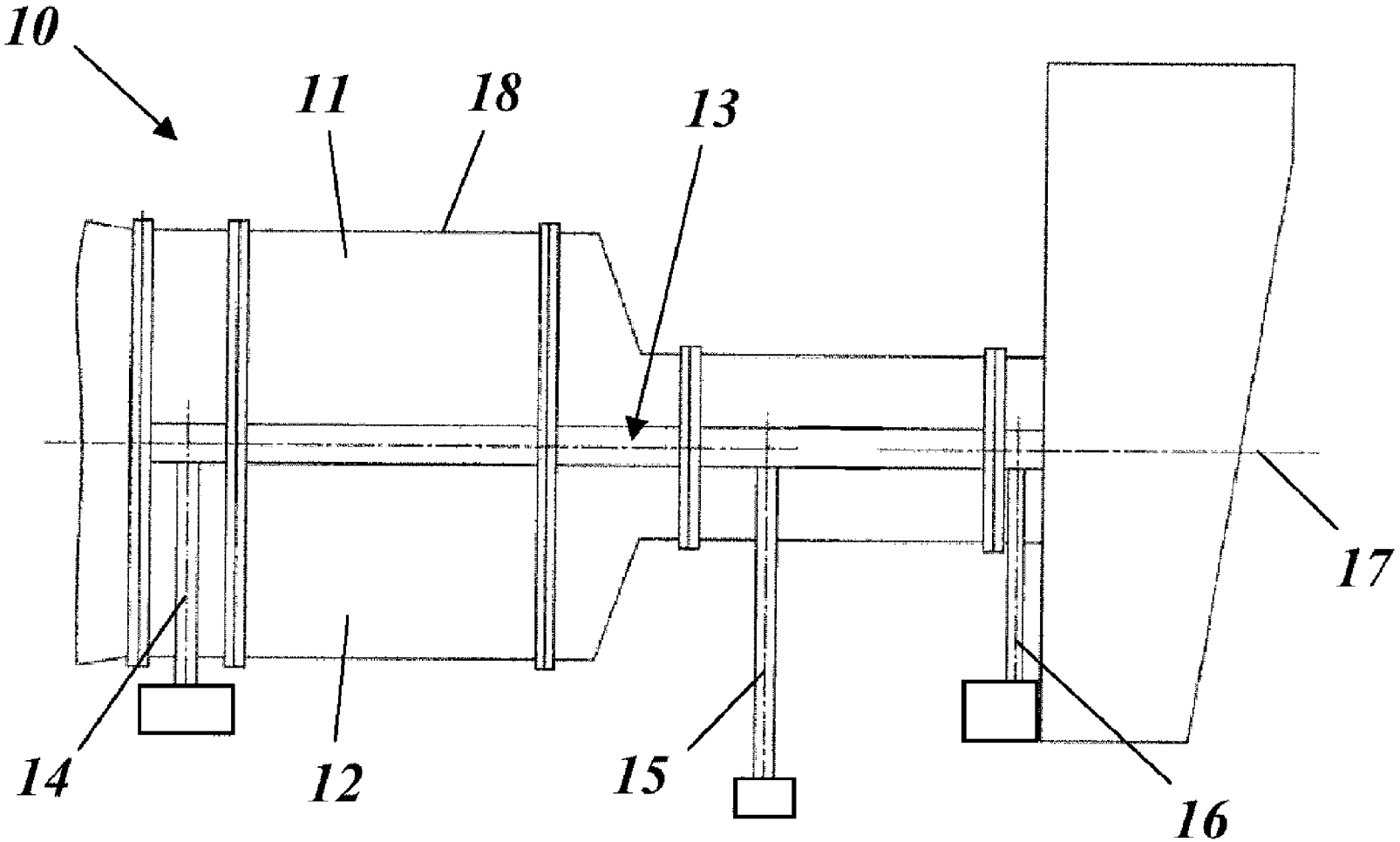
Fig.1 (Prior Art)
FIG. 1 shows, in side view, an exemplary configuration of a turbine support which acts on the outer casing.
Figure 3:
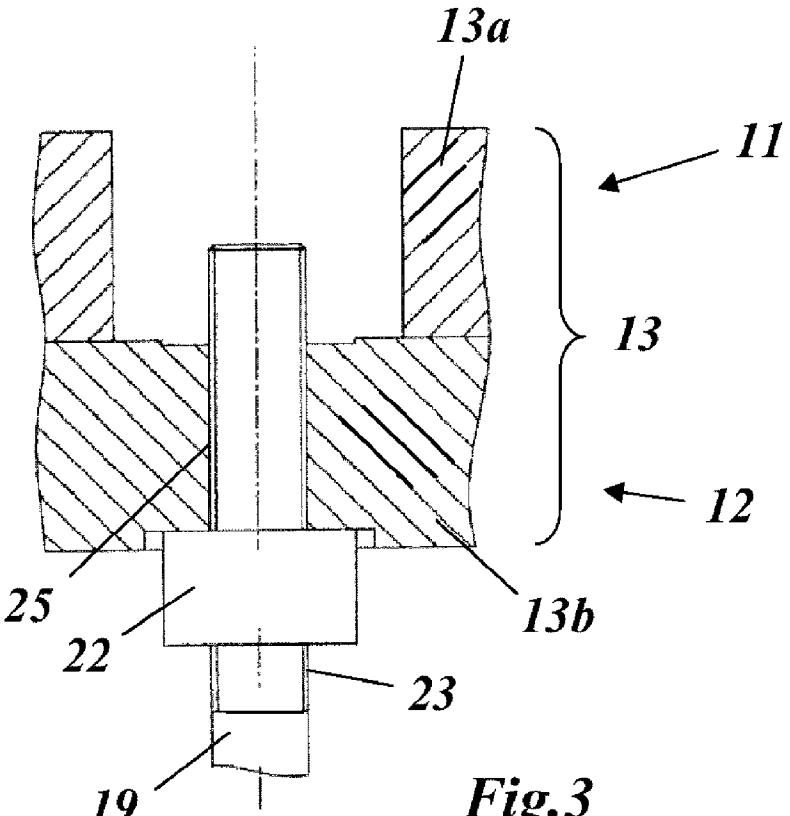
Fig.3 (Prior Art)
FIG. 3 shows in detail a second variant of a previously used support on the horizontal flange which excludes a threaded flange connection at this location.
Figure 2:
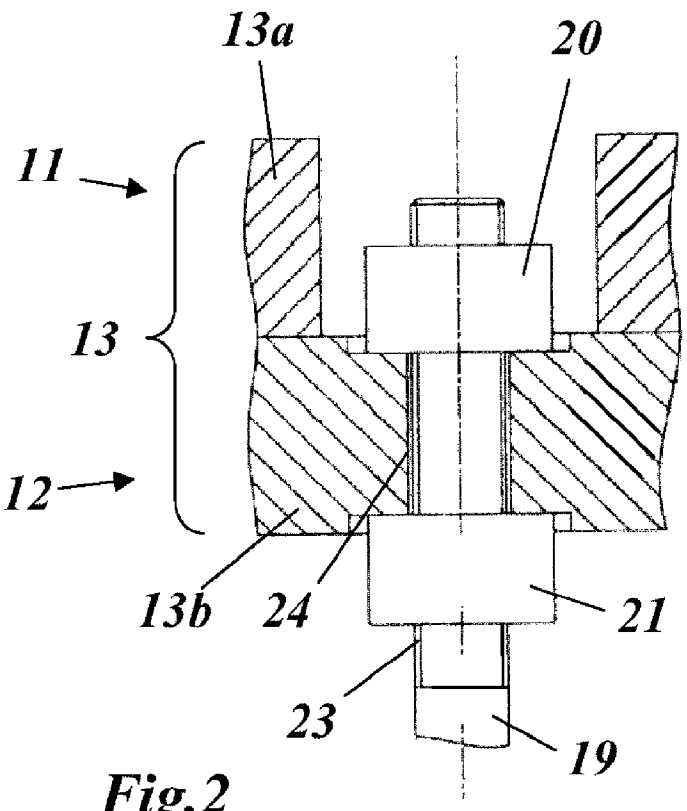
Fig.2 (Prior Art)
FIG. 2 shows in detail a first variant of a previously used support on the horizontal flange which excludes a threaded flange connection at this location.
Figure 4:
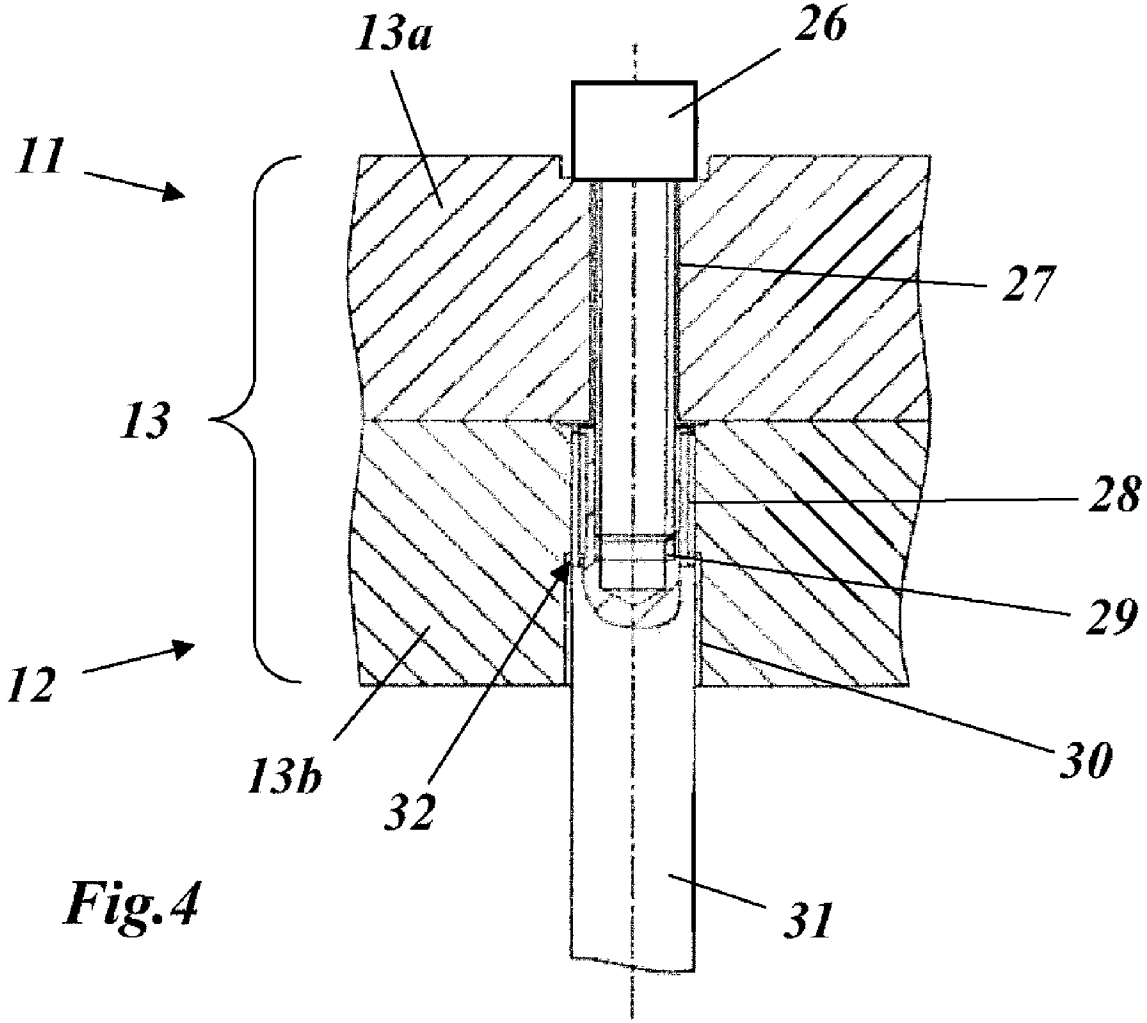
FIG. 4 shows an exemplary embodiment of a support according to the invention with combined support and threaded flange connection.

In FIG. 4, in an enlarged detail and in a view which is comparable to FIGS. 2 and 3, an exemplary embodiment of a support according to the invention with combined support and threaded flange connection is reproduced. The support 31, which is supported on the ground or on a foundation, is screwed by a threaded section 28, which is applied at the upper end, into the lower flange 13*b* from the bottom far enough for the end face of the support 31 to terminate approximately flush with the upper side of the lower flange 13*b*. A through-hole 30, which in the upper half has a corresponding female thread, is provided in the lower flange 13*b* for this purpose.

A through-hole 27, through which a flange screw 26 can be inserted, is arranged in the upper flange 13*a* concentric to the through-hole 30 in the lower flange 13*b*. The length of the flange screw 26 is selected so that it projects substantially downwards from the upper flange 13*a*, but ends inside the lower flange 13*b*. The flange screw 26 is supported by its screw head on the upper side of the upper flange 13*a* and by the part which projects downwards from the upper flange 13*a* is screwed into a (concentric) threaded hole in the support 31 which is provided for the flange screw 26. Since the support 31 in its turn is screwed into the lower flange 13*b*, by drawing up the flange screw 26 the two flanges 13*a* and 13*b* can be pressed tightly against each other directly in the region of the support 31.

In this way, the points of application of the supports on the horizontal flange 13 of the outer casing can be optimally positioned without a threaded flange connection having to be dispensed with at these points. Likewise, no additional integral castings are required.

It is also basically conceivable, however, to omit the threaded section 28 on the support 31 and instead to provide corresponding steps on the support 31 and in the through-hole 30 in the outside or inside diameter, as the case may be, so that the support 31 which is inserted into the through-hole 30 can be supported on the lower flange 13*b*.

It is particularly advantageous to screw the support 31 by the threaded section 28 into the lower flange 13*b* up to a stop 32 in such a way that a sufficient gap remains between the upper end face of the support 31 and the underside of the upper flange 13*a* so that the support 31 does not have to absorb direct forces from the upper flange 13*a*.

List of Designations

10 Turbine
11 Upper section (outer casing)
12 Lower section (outer casing)
13 Horizontal flange
13*a* Upper flange
13*b* Lower flange
14, 15, 16 Support
17 Machine axis
18 Outer casing
19 Support
20, 21 Fastening nut
22 Locknut
23 Male thread
24, 27, 30 Through-hole
25 Threaded hole
26 Flange screw
28 Threaded section
29 Threaded hole
31 Support
32 Stop While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A support system for a turbine, which system comprises:
an outer casing which is split into an upper section and a lower section in a horizontal parting plane, the outer casing including a horizontal casing flange;
a horizontal threaded flange connection at the parting plane securing the upper section and the lower section to each other at the horizontal casing flange;
a support comprising a plurality of vertical supports each having an upper end bearing on the outer casing and a lower end configured to be supported on a foundation;
wherein the horizontal threaded flange connection comprises at least one of the plurality of vertical supports which has an upper end bearing on the horizontal casing flange;
wherein the horizontal casing flange comprises an upper flange, a lower flange, and screws connecting the upper and lower flanges to each other;
wherein the upper end of the at least one vertical support is attached to the lower flange so that said upper end is accessible from an upper side of the lower flange;
a through hole in the upper flange; and
a flange screw screwed in the through-hole in the upper flange and into the at least one vertical support.

2. The support system as claimed in claim 1, wherein the at least one vertical support comprises a thread so that the at least one vertical support can be screwed into the lower flange.

3. The support system as claimed in claim 2, wherein the lower flange comprises a stop positioned so that the at least one vertical support can be screwed into the lower flange up to the stop leaving a gap between the upper end face of the at least one vertical support and an underside of the upper flange.

4. The support system as claimed in claim 1, wherein the at least one vertical support comprises a cylindrical rod having an upper end face and a threaded hole extended from the upper end face for receiving the flange screw.

5. The support system as claimed in claim 1, wherein the upper end of the at least one vertical support is flush with the upper side of the lower flange.

* * * * *